US005735506A

United States Patent [19]

Warnan et al.

[11] Patent Number: 5,735,506

[45] Date of Patent: Apr. 7, 1998

[54] WINCH WITH HYDRAULIC MOTOR ESPECIALLY FOR HELICOPTER EQUIPPED WITH SONAR

[75] Inventors: François Warnan, Rambouillet; Daniel Canto, Ballainvilliers, both of France

[73] Assignee: Thomson-CSF, Paris, France

[21] Appl. No.: 666,470

[22] PCT Filed: Dec. 23, 1994

[86] PCT No.: PCT/FR94/01529

§ 371 Date: Jun. 28, 1996

§ 102(e) Date: Jun. 28, 1996

[87] PCT Pub. No.: WO95/18061

PCT Pub. Date: Jul. 6, 1995

[30] Foreign Application Priority Data

Dec. 30, 1993 [FR] France ..... 93 15883

[51] Int. Cl.[6] ..... B66D 1/08

[52] U.S. Cl. ..... 254/361; 254/377

[58] Field of Search ..... 254/361, 377

[56] References Cited

U.S. PATENT DOCUMENTS

| | | | |
|---|---|---|---|
| 3,035,414 | 5/1962 | Smith | 254/361 |
| 3,780,990 | 12/1973 | Edlund et al. | 254/361 |
| 4,004,779 | 1/1977 | Flesburg | 254/377 |
| 4,188,790 | 2/1980 | Pedersen | 254/361 |
| 4,275,870 | 6/1981 | Henneman et al. | 254/361 |
| 4,555,092 | 11/1985 | Overholt | 254/377 |
| 4,861,297 | 8/1989 | Warnan . | |
| 4,954,110 | 9/1990 | Warnan . | |
| 4,991,534 | 2/1991 | Warnan et al. . | |
| 5,014,953 | 5/1991 | Warnan et al. . | |
| 5,044,160 | 9/1991 | Warnan et al. . | |
| 5,091,894 | 2/1992 | Warnan . | |
| 5,381,909 | 1/1995 | Warnan . | |

*Primary Examiner*—Katherine Matecki

*Attorney, Agent, or Firm*—Oblon, Spivak, McClelland, Maier & Neustadt, P.C.

[57] ABSTRACT

A winch operates with a hydraulic motor which is supplied by a servo-valve. The servo-valve is connected as a 3-way system so that the supply hose used as a discharge when the load is being winched up is connected directly to the fluid return and so that during the descent, this motor is no longer supplied with high pressure and the fluid is circulated in a closed circuit without pressure. Fluid is refreshed with a flow rate low enough so that it does not excessively increase the supply of energy, but high enough that it limits the overheating of the fluid.

10 Claims, 2 Drawing Sheets

WINCH WITH HYDRAULIC MOTOR ESPECIALLY FOR HELICOPTER EQUIPPED WITH SONAR

BACKGROUND OF THE INVENTION

1. Field of the Invention

Figure 1:
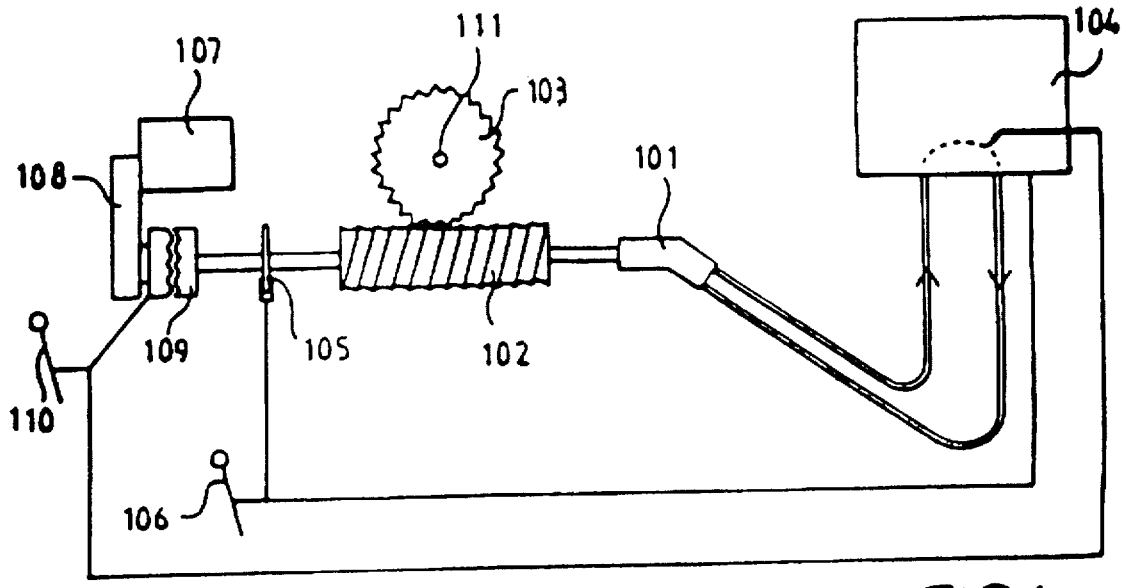

The present invention relates to winches which are moved by a hydraulic motor. It applies more particularly to winches equipping helicopters and which especially allow there to be immersed in the sea a sonar known as a "dipping sonar" which is suspended from the end of the cable of the winch so that it can be brought back on board the helicopter afterwards.

2. Discussion of the Background

Helicopters are often equipped with a winch which allows loads to be set down and picked back up in places which are difficult to access, by making the helicopter hover.

In the case of helicopters specialized for submarine hunting, use is made of a very specific winch which, with the aid of an electric supporting cable, allows a specialized sonar to be immersed for detecting the presence of a submarine, and allows this sonar to be recovered in order to go and take measurements a little further on.

Such a mission imposes particularly severe stresses on the device employed. Indeed it is necessary to be able to lower and to raise the sonar with a high average speed, typically 5 m per second, while protecting the cable which is relatively fragile in order to avoid loss of the sonar. Furthermore, it is also necessary to ensure the safety of the helicopter by avoiding sharp and excessive forces at the winch by avoiding the overheating of the oil of the hydraulic circuit, because the volume of hydraulic fluid is low for reasons of weight and there is therefore the risk of its temperature rising rapidly and exceeding the safety temperatures. These constraints have to be respected while at the same time maintaining good reliability and nevertheless keeping down the cost of the device.

Winches are known which are designed so that descent takes place by free fall by mechanically disengaging the motor from the drum on which the cable is wound. This method is clearly dangerous.

The winches most commonly used at the present time include a hydraulic motor which both allows the sonar to be raised back up and allows its descent to be controlled. Such a winch assembly has been represented diagrammatically in FIG. 1.

In this winch, a hydraulic motor 101 drives a worm 102 which itself drives a wheel 103 keyed to the shaft 111 of the drum on which the cable is wound and unwound. This worm system makes it possible in a simple and reliable manner to obtain the desired reduction ratio. It does, however, have the drawback of having a low efficiency, some 40%, in the reverse direction. In this mode of operation, that is to say when the load on the cable is driving the hydraulic motor when this load is descending, this low efficiency here is of little inconvenience bearing in mind the control circuits used, represented diagrammatically by the hydraulic control unit 104.

Furthermore, use is made of a brake 105 actuated by the hydraulic energy of the unit 104 or with the aid of a control lever 106. This brake allows the winch to be immobilized in periods when it is not operating.

Finally, in order for it to be possible for the winch to be operated even if the hydraulic system breaks down, an electric motor 107 is provided which drives the worm 102 by means of a reduction gear 108 and a dog clutch 109. This dog clutch is engaged mechanically by a second control lever 110 which furthermore mechanically controls a discharge valve situated in the hydraulic unit 104, which allows the hydraulic motor 101 to rotate freely in such cases.

Figure 2:
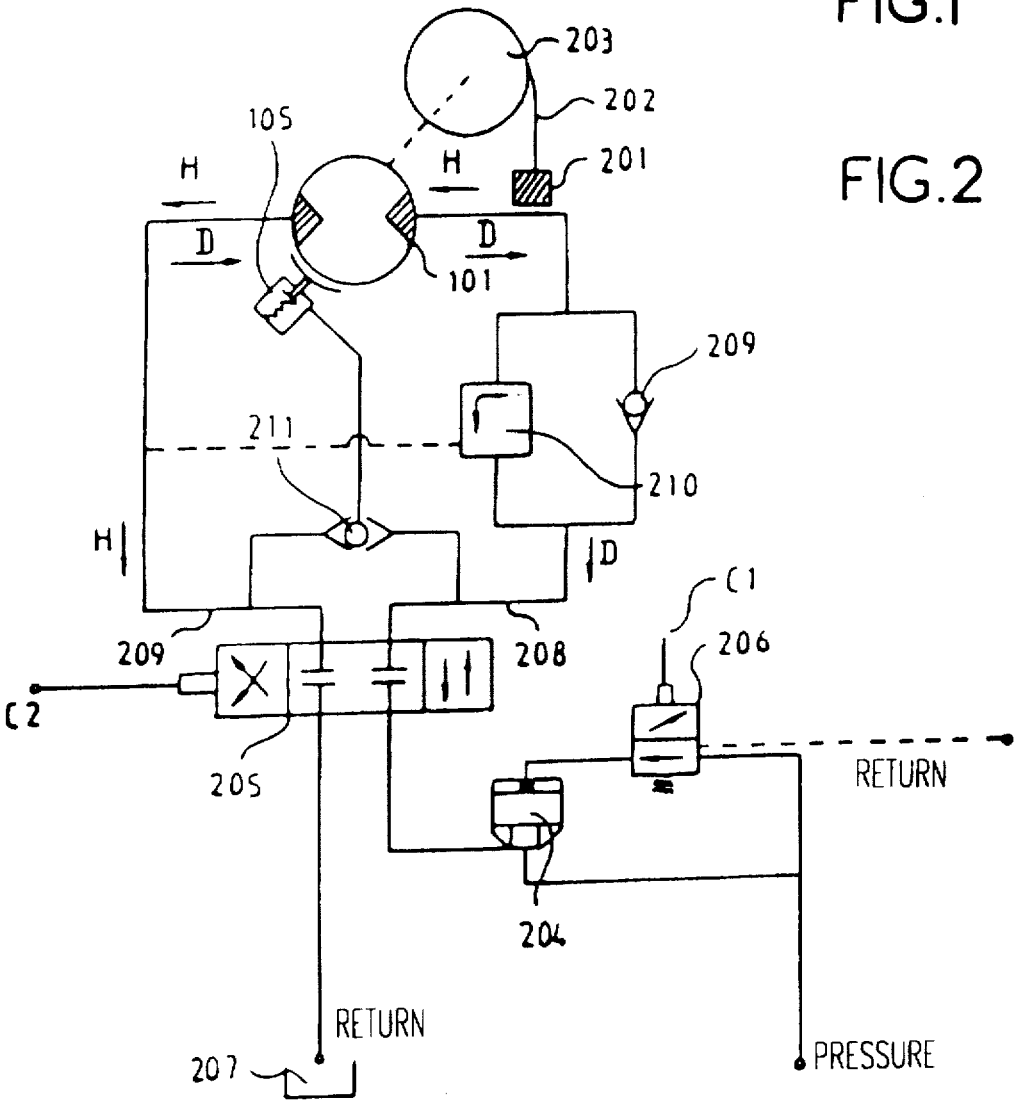

FIG. 2 represents the mechanical part of FIG. 1, simplified, and the hydraulic unit 104 in greater detail.

The load 201 on the winch is fastened to the end of a cable 202 which is wound on a drum 203. This drum 203 is driven by the hydraulic motor 101 itself released, or immobilized, as the case may be, by a brake 105.

The motor 101 is fed from a source of hydraulic fluid under pressure P by means of a shut-off valve 204 and of a 4-way servo-valve 205. The shut-off valve makes it possible to apply all of the pressure to the servo-valve under the control of a pilot electro-valve 206. The latter, on the basis of a low-power electric control signal C1, applies a control pressure to the shut-off valve 204 which releases the main pressure. Upon stopping, the control fluid for the valve passes back through the pilot electro-valve to return to the fluid reservoir 207 via a return R. This reservoir has been represented with the appearance of an open tank, but this representation is purely symbolic and it is in fact the main hydraulic-fluid reservoir of the helicopter, from which this fluid is repressurized and sent back to the inlet P.

The servo-valve 205 is of the known 4-way type, controlled proportionally under the effect of a low-power electric control signal C2. This servo-valve makes it possible, on the one hand, to reverse the direction of flow of the hydraulic fluid between, on the one hand, circuits P and R and, on the other hand, the two hoses for supply and discharge of the motor, and, on the other hand, to regulate precisely the quantity of hydraulic fluid allowed into the motor and therefore the supply pressure thereof, that is to say in definitive terms, the power delivered to the motor and its speed.

In the raising or winching-up direction represented by the arrows H for winding up the cable, the supply pressure is applied to a hose 208 which supplies the motor through a non-return valve 209 shunted by a check valve 210, the function of which will be explained later. At the outlet from the motor, the hydraulic fluid returns to the return R by a hose 209 then via the servo-valve 205. A valve of the shuttle-valve type 211 is fed simultaneously by the hoses 208 and 209 and allows the brake 105 to be released both when pressure is applied to the hose 208 and when it is applied to the hose 209, thus releasing the motor both for the raising and for the descent, when this motor does actually receive a supply pressure.

For the descent, featured by the arrows D, the servo-valve 205 crosses over the paths of the hydraulic fluid. Thus, the pressure P is applied to the hose 209 and the motor operates in reverse, allowing this descent to be controlled. This pressure is then also applied to the valve 210, which frees the passage of the fluid returning towards the hose 208 then towards the reservoir 207. In this way, in the event of a malfunction of the brake 105 releasing the motor in the absence of raising or descent control pressure, the delivery of the hydraulic fluid by the motor towards the hose 208 is blocked by the non-return valve 209 and the check valve 210, which very substantially stops this motor, give or take the leakage, and therefore prevents the load from descending freely under its own weight.

in this device, during the descent, the hydraulic fluid passes twice into the servo-valve 205 and the operation of this motor is thus fully controlled by this servo-valve. Since the load tends to descend naturally under the effect of its own weight, this control is excessive, which in particular increases the various hydraulic transients (shock waves, resonance, cavitation . . . ) and may lead to jerky movements of the load during its descent.

Furthermore, the hydraulic control of the motor on the basis of the pressure leads on the one hand to a consumption of power which is profitless as regards the helicopter for which this power is measured, and a heating-up, itself also profitless, of the oil in the hydraulic circuit. Indeed, the energy resulting from the descent of the load is essentially dissipated at the motor by heating up the oil, and what is more the drop in pressure of this oil between the supply and the return is itself dissipated as heat, essentially by throttling at the servo-valve. By way of example, the descent of a load of some 250 newtons at 5 m per second over a height of 750 m requires the use of 36 litres of fluid per minute at a pressure of 200 bar, which corresponds to a power of 12 kW which has to be dissipated. Since the volume of fluid available for such a purpose is some 20 l, the dissipation of this energy causes the temperature of these 20 l to rise by approximately 30° C. Such a temperature rise could perhaps be acceptable if taken in isolation, but the repetitive nature of these manoeuvres, frequently necessary under operating conditions, leads to a much greater total temperature rise which is the source of numerous drawbacks such as excessive expansion of the hydraulic members, deterioration of the oil, and a release of heat into the helicopter which has to be dissipated by cooling systems.

SUMMARY OF THE INVENTION

In order to alleviate these drawbacks, the invention proposes a winch with hydraulic motor especially for helicopter equipped with sonar, of the type comprising a reversible hydraulic motor for driving the winch, fed by a servo-valve as well as by a first supply hose and a second supply hose, mainly characterized in that this servo-valve is connected to the motor by the first hose and that the second hose is connected directly to the return circuit for the hydraulic fluid, the servo-valve allowing the first hose to be fed with hydraulic fluid under pressure for winching-up, and allowing this first hose to be connected to the second hose to allow the hydraulic fluid to circulate in closed circuit without pressure for descent, during all of this descent.

According to another feature, the said servo-valve is a 4-way servo-valve used essentially as a 3-way valve.

According to another feature, the winch further includes a third hose connecting the servo-valve to the second hose to allow the hydraulic motor to be supplied, during the descent, with hydraulic fluid under pressure in just sufficient quantity to avoid the overheating of the fluid circulating in closed circuit.

According to another feature, the means by which the drum is driven by the motor consist of gears having good efficiency both in the reverse direction and in the forward direction.

According to another feature, these drive means comprise a means of transmission through an angle using a bevel gear followed by an epicyclic gear set.

According to another feature, the winch comprises means for furthermore supplying the casing of the motor with hydraulic fluid under pressure with sufficient flow rate to limit any possible additional overheating.

According to another feature, the winch comprises a back-up electric motor connected to the hydraulic motor by a clutch controlled by a ram which engages this clutch under the effect of a lack of pressure.

According to another feature, this clutch also operates as a torque limiter.

According to another feature, the winch further comprises a fourth hose connecting the first and second hoses by means of a relief valve which allows the delivery pressure to be released when the winch starts to rotate in the opposite direction during winching-up as a result of the load accidentally catching.

According to another feature, the winch further comprises a bypass valve which short-circuits the relief valve when the pressure of the hydraulic fluid starts to drop.

BRIEF DESCRIPTION OF THE INVENTION

Figure 3:
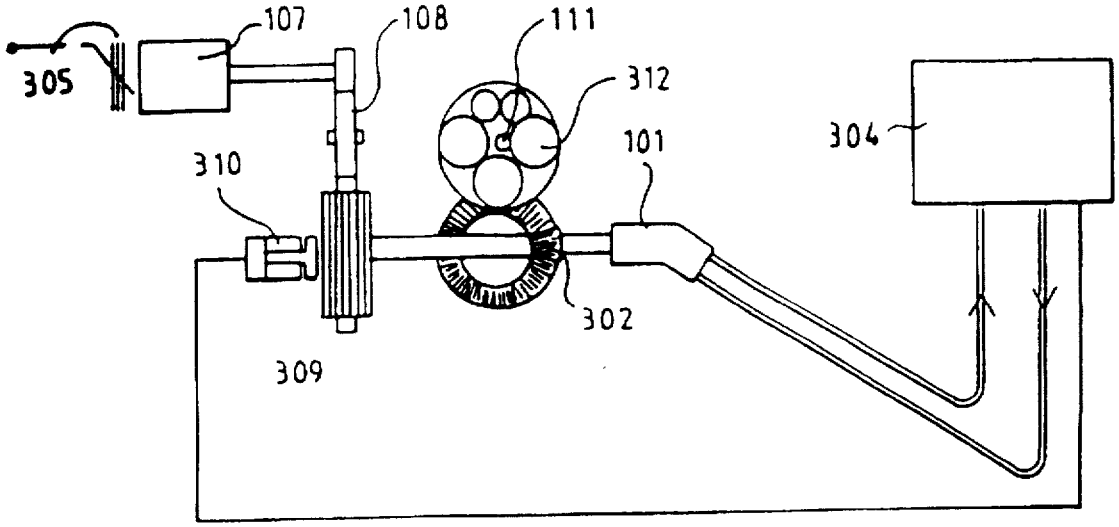

Other specific features and advantages of the invention will emerge clearly in the following description given by way of non-limiting example with reference to the appended figures which represent:

FIG. 1, a diagrammatic view of a known winch;

FIG. 2, a detailed diagram of the control members 104 of FIG. 1;

FIG. 3, a diagrammatic view of a winch according to the invention; and

Figure 4:
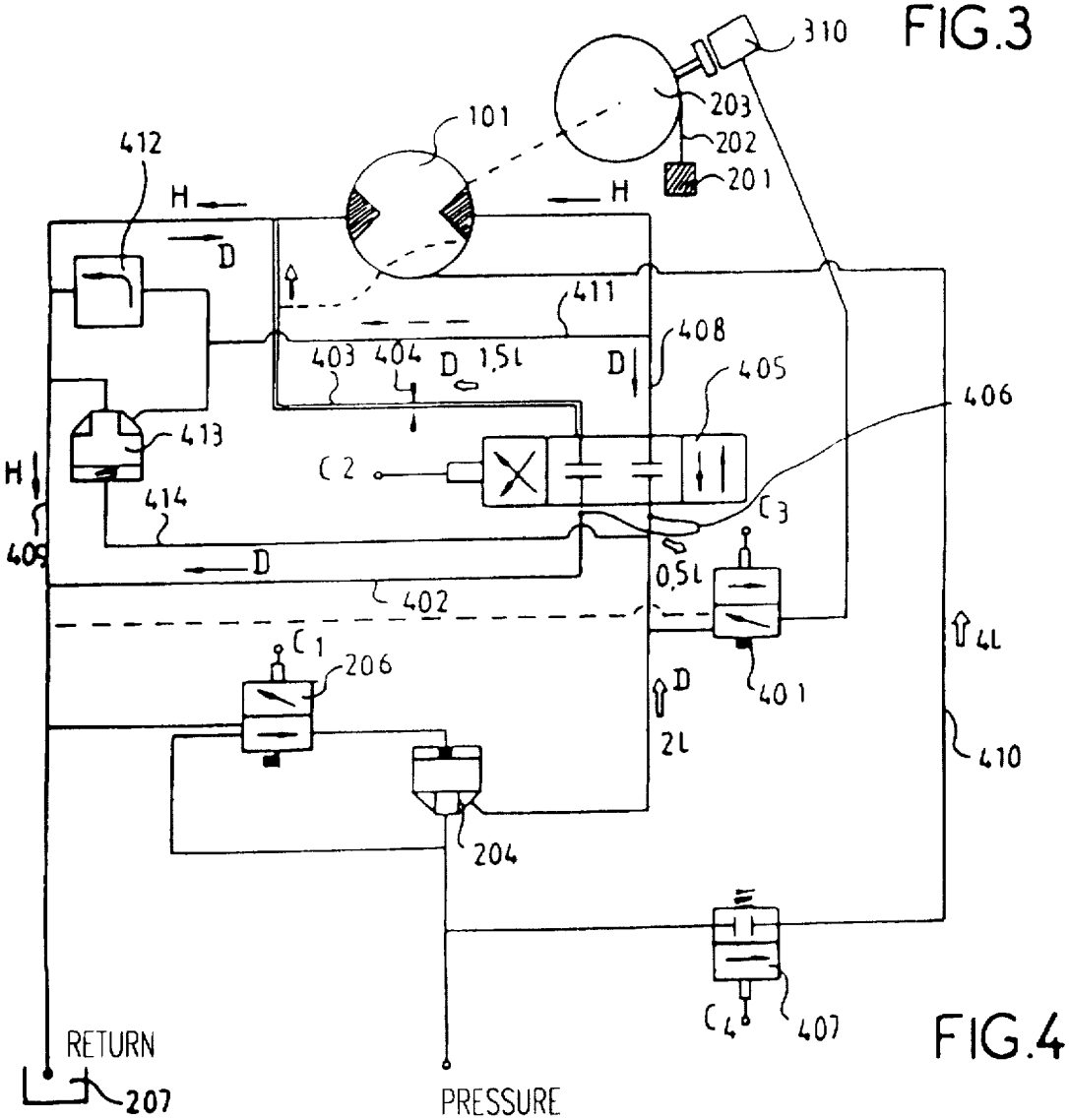

FIG. 4, a detailed diagram of the control members 304 of FIG. 3.

DISCUSSION OF THE PREFERRED EMBODIMENTS

The diagram of a winch according to the invention represented in FIG. 3 is simplified in the same way as the diagram of FIG. 1.

The hydraulic motor 101 drives the shaft 111 of the drum of the winch this time via a means for transmission through an angle with bevel gear 302 followed by an epicyclic gear set 312. This gearing system makes it possible to obtain a much better efficiency in the reverse direction than the worm system of the prior art, but other reduction-gear systems giving the same result could be used. It will be seen hereafter that this point is important in the invention.

The shaft of the hydraulic motor is moreover connected to a back-up electric motor 107 by means of a clutch 309 and a reduction gear 108. This clutch is released by a ram 310 which operates under the hydraulic pressure from a hydraulic control unit 304. Thus, in the event of a hydraulic breakdown, the pressure disappears and the ram releases the clutch which engages and mechanically connects the electric motor to the shaft of the hydraulic motor. This operation takes place automatically in the event of a breakdown and there is thus no manual intervention required in this case.

The electric motor itself includes an electrically controlled brake 305 operating on lack of current. The electric control thus consists in sending current to the brake 305, which releases it, and to the motor 107, which makes it turn.

Thus, when switching over to electrical operation, if the motor is not powered the winch is automatically stopped in the position which it has reached, without any possibility of it unwinding by itself.

Furthermore, it is observed that by comparison with the diagram of FIG. 1, the stop control of the hydraulic unit from the control device 110 used for engaging the electric motor with the shaft of the hydraulic motor no longer exists, for the reasons which will be explained later.

The detailed diagram of the winch is represented in FIG. 4 using the same conventions as FIG. 2.

The hydraulic motor 101 connected to the drum 203 supporting the load 201 via the cable 202 is supplied from the source of hydraulic fluid under pressure via a shut-off valve 204 piloted by a pilot electro-valve 206 receiving a control signal C1.

This fluid under pressure is applied to the motor via a servo-valve 405 of the same type as the 4-way servo-valve 205 but this time used as a 3-way valve. This different use is achieved simply at the connections to the valve.

In the direction of raising, featured by the arrows H, the hydraulic fluid passes through the servo-valve 405 via a hose 408 then returns to the return in the reservoir 207 via a hose 409 which is this time connected up directly to this reservoir without passing through the servo-valve, hence the 3-way operation. This difference already makes it possible to obtain a smaller drop in pressure head, and hence better use of the available energy.

The clutch control 310 receives the hydraulic pressure from the shut-off valve 204 via a clutch electro-valve 401 controlled by an electric signal C3. This electric signal C3 makes it possible to engage the electric motor with the hydraulic motor as desired, even when pressure is established. By contrast, in the absence of pressure as has already been seen, clutch engagement is automatic.

For the descent of the load, featured by the arrows D, the servo-valve 405 crosses over the hydraulic circuits under the control of the electric signal C2. Under these conditions, the hydraulic fluid under pressure is applied to one outlet of the servo-valve which is plugged for the 3-way operation, apart from the alternative form described later. The hydraulic fluid leaving the motor 101, which turns while being driven by the drum 203 under the tension on the cable 202, passes into the servo-valve 405 and is looped back to the hose 409 via a return hose 402. The sucking of the motor 101 prevents this fluid from returning to the reservoir 207 and causes it to travel in a direction D back to motor 101 through hose 409. In this way, the hydraulic fluid circulates in closed circuit in the circuit indicated by the arrows D, and since the mechanical drive system using bevel gear and epicyclic gear set has a good efficiency in reverse, a "natural" dynamic equilibrium becomes established which has the particular feature of being stable and of not leading to the operating irregularities described in the prior art.

Furthermore, the fluid which thus circulates in closed circuit is subject only to the pressure delivered by the motor which is used simply to circulate this fluid. The power thus dissipated is therefore very low and it is possible to avoid having to dissipate the power previously delivered by the source of high pressure as pure loss.

Finally, it is also possible to regulate the speed of descent by controlling a greater or lesser aperture of the servo-valve 405 by means of the control circuit C2, this making it possible to throttle the hydraulic fluid to greater or lesser extents in its return circuit.

In the prior art, the speed at which the cable is unwound was in principle fixed by the speed of rotation of the drum fixed by the motor which operated under the effect of the applied oil pressure. In principle, the control members were designed to fix a speed which corresponded to the natural descent of the sonar under the effect of its own weight. In practice, there was nevertheless a risk that the drum would start to turn too quickly and would unwind the cable too rapidly, thus leading to a risk of the turns detaching from the drum and becoming entangled which may lead to abrupt blockage of the assembly. The invention makes it possible to do away with this risk by obtaining a natural equilibrium without any constraint because it is the tension in the cable which moves the drum by pulling. This means that the cable always remains taut and can no longer become detached.

Furthermore, in contrast with the prior art, there is no longer any need to use a bypass system on the hydraulic circuit intended for short-circuiting the motor in the event of a hydraulic breakdown and of switching to the electric motor for winching up the load. In fact, in the prior art, since the servo-valve is closed in the event of a hydraulic breakdown, the motor can neither draw in nor deliver and this inability to deliver leads to it becoming blocked unless of course the delivery is short-circuited to the intake using a bypass. However, such a bypass constitutes an additional component which can, moreover, itself malfunction and which has to be switched in positively in the event of a malfunction. Since in the invention there is no passage via the servo-valve on delivery, the motor is free to deliver all the fluid it contains. It cannot, theoretically at least, and depending on the state of the pressure in the various hydraulic circuits, draw in, but this circumstance does not cause it to become blocked because when it is empty it can nevertheless rotate, simply with very slight braking. Furthermore, it is observed that this same circumstance prevents the drum and the motor from rotating in the opposite direction under the effect of the load when this breakdown occurs during winching-up, because in this case the delivery will take place on the closed side of the servo-valve. This prevents the load from redescending of its own accord, without having to provide specific safety devices.

Nonetheless, another problem, that of heating, is encountered due to the fact that the amount of oil circulating is of a very small volume. Indeed, if we refer to the numerical example described earlier, the tension in the cable during the descent of the sonar into the water, which is substantially some 250 newtons for a speed of 5 m per second, corresponds to a power of some 1 kW. Assuming that the losses in the various mechanical drive members represent some 0.5 kW, there are still 0.5 kW which have to be dissipated in the hydraulic circuit. The amount of energy to be dissipated is therefore much lower than that of the prior art. Nonetheless, since these 500 W would have to be dissipated in the absence of other devices in an oil volume of substantially 50 $cm^3$, the overheating would be difficult not to accept, even for a single manoeuvre.

In order to alleviate this drawback, the invention proposes to refresh the oil, using a pipe 403 which is connected up between the outlet from the electro-valve which was said earlier theoretically to be plugged, but which is now therefore slightly open in order to feed this pipe, and the hose 409 which allows the fluid to return to the motor when it is operating as a pump during the descent. This feeding takes place of course under the pressure P, and in order to avoid an excessive supply of energy, the flow rate is limited preferably using a pipe of narrow cross-section or restriction featured in the figure as a flow restrictor 404.

As a numerical example, it is possible to inject 2 l per minute under the pressure of 200 bar supplied by the valve 204. Of course, the excess oil heated up in the motor is discharged to the return R. This oil is hot whereas the oil which comes to replace it is cold, and although this adds an additional power of approximately 700 W, overheating is avoided because the hot oil is taken back to the reservoir 207 from the return R.

Furthermore, in practice servo-valves of this type operate not directly under the control of an electromagnet powered by the signal C2, but by means of a small intermediate hydraulic circuit known as "control flow rate" circuit represented in the figure by the loop 406 between the hose 402 and the one which arrives from the valve 204. This loop consumes a flow rate of approximately 0.5 l of fluid which has to be taken into account when assessing the additional oil injected, and under these conditions the flow rate in the hose 403 is limited to substantially 1.5 l.

The operations which have been described hitherto relate to the descent of the payload (the sonar) into the water, because this is the phase which lasts the longest, approximately 3 min. However, before entering the water the sonar covers the distance between the helicopter and the water surface. This takes place very rapidly, a few seconds, because the distance is short, approximately 20 metres, and because the load is then some 800 newtons, namely 3 to 4 times greater than in the water. Because of the small volume of fluid used in the invention, the overheating that occurs during these few moments and which corresponds to the dissipation of an additional power of approximately 3 kW for a few seconds may be too great. In order to avoid this effect, the invention proposes to increase further the additional flow rate of oil in the motor by using this time a circuit which is already known elsewhere and which consists in letting a flow rate of fluid into the casing of the motor by means of a hose 410 fed by an electro-valve known as the heater valve 407. This circuit is normally used to heat up the hydraulic circuit when it is very cold, hence its name. According to the invention, upon initialization of the descent from the helicopter, this electro-valve will be actuated by a control signal C4 which will be stopped when it is detected that the sonar is entering the water. This detection takes place using known means because it is employed for other uses in the known operation of the winch. By using an additional flow rate of 4 l of fluid per minute in this way, it is thus possible to limit the increase in temperature of this fluid to 30° C., which is entirely satisfactory. The power dissipated during this short moment may reach 3 kW.

In order furthermore to solve the problem of excess tension in the cable when, during hydraulic winching-up, the load becomes caught up on the bottom or carried along and starts to pull on the cable because of the relative motion between the helicopter and the point at which the load is caught, a load sensor which forms part of the known means of the winch makes it possible to obtain a signal controlling the opening of the electric brake 305 and for releasing the clutch 309. The motor then starts to rotate in the opposite direction as a pump and delivers on the hose 408. In order to avoid the delivery pressure becoming greater than the inlet pressure, which could damage the hydraulic system, use is made of a hose 411 which connects the hoses 408 and 409 via a relief valve 412, set for example to 220 bar. This valve opens under the effect of the excess pressure and the fluid is returned to the return, which causes the pressure to drop and avoids damage, particularly to the servo-valve 405. This situation theoretically lasts only as long as is necessary to open the servo-valve in order to release the pressure. This opening takes place after it has been detected that the load has become caught up, at system control logic level or, as last resort, manually.

When this same incident occurs during electric winching-up, use is made of a bypass valve 413, set for example at 100 bar, which short-circuits the relief valve 412 and is controlled by a hose 414 connected to the pressure inlet on the hose between the valve 204 and the servo-valve 405. As electric winching-up is used as a back-up measure because there is no longer any hydraulic pressure, the absence of pressure in the hose 414 causes the bypass valve 413 to open, which allows the motor to deliver on the return.

Finally, when there is a complete hydraulic and electrical breakdown, it is of course no longer possible to control anything. In these conditions, the clutch is engaged and, to avoid any possibility of damage, the invention anticipates designing this clutch as a torque limiter in order to make it slip, this allowing the cable to be paid out by braking at this clutch and by throttling of the fluid in the bypass valve.

All of the control signals C1 to C4 will advantageously be obtained using a microprocessor which is suitably programmed and linked to the various sensors of the winch.

We claim:

1. Winch with a hydraulic system, comprising:

a reversible hydraulic motor driving a winch cable for raising and lowering a load connected to the winch cable;

a source of hydraulic fluid at an elevated pressure;

a first supply hose connected to said motor for driving the motor in a direction to raise the load when hydraulic fluid from said source is supplied to said motor via said first supply hose;

a servovalve connected to said first supply hose and to said source for selectively connecting said first supply hose to said source to supply hydraulic fluid to said motor for raising the load;

a second supply hose directly connecting said motor to a low pressure hydraulic fluid return; and a return hose connecting said servovalve to said second supply hose, wherein said servovalve is movable to a position connecting said first supply hose to said return hose so that hydraulic fluid can circulate in a closed circuit substantially without pressure during a descent of the load.

2. Winch according to claims 1, including means not including said servo value for supplying the motor with hydraulic fluid under pressure.

3. The winch of claim 1 wherein said servovalve is a four way servovalve having a substantially plugged port so as to function as a three way servovalve.

4. Winch according to claims 3 characterized in that it further includes a third hose connecting the servo-valve to the second hose to allow the hydraulic motor to be supplied, during the descent, with hydraulic fluid under pressure in just sufficient quantity to avoid the overheating of the fluid circulating in closed circuit.

5. The winch of claim 4 including means connecting said motor to the winch cable, said connecting means including a gear train having substantially the same efficiency when rotating in two directions.

6. The winch of claim 5 wherein said gear train includes a bevel gear and an epicyclic gear set.

7. Winch according to claim 4 including a back-up electric motor connected to the hydraulic motor by a clutch controlled by a ram which engages said clutch in response to a lack of hydraulic pressure.

8. Winch according to claim 7, wherein said clutch also acts as a torque limiter.

9. Winch according to any claim 4, characterized in that it further comprises a fourth hose connecting the first and second hoses, by means of a relief valve.

10. Winch according to claim 9, further comprising a bypass valve which short-circuits the relief valve when the pressure of the hydraulic fluid starts to drop.

* * * * *